US006237613B1

(12) United States Patent
Finnigan

(10) Patent No.: US 6,237,613 B1
(45) Date of Patent: May 29, 2001

(54) TWO-PIECE COSMETIC APPLICATOR

(75) Inventor: Deborah M. Finnigan, Toledo, OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

(21) Appl. No.: 09/387,397

(22) Filed: Sep. 2, 1999

(51) Int. Cl.[7] ..... A45D 40/24; A45D 40/26; B43K 21/02

(52) U.S. Cl. ..... 132/318; 132/320; 401/59

(58) Field of Search ..... 132/318, 320; 401/60, 59; 206/823, 817, 385

(56) References Cited

U.S. PATENT DOCUMENTS 1,731,721 * 10/1929 McGowan ..... 401/59
3,810,700 * 5/1974 Bryan ..... 401/59
4,367,965 * 1/1983 Speitel et al. ..... 401/60
4,721,403 * 1/1988 Zinnbauer ..... 401/82
4,723,858 2/1988 Zinnbauer ..... 401/59
5,568,989 10/1996 Benguigui ..... 401/59

* cited by examiner

*Primary Examiner*—Ralph A. Lewis
*Assistant Examiner*—Robyn Kieu Doan

(57) ABSTRACT

A two-piece cosmetic applicator operable with one hand for dispensing cosmetic products such as lipstick, lip balm and the like is disclosed. The applicator is an assembly of a sheet stock preform and a product elevator. The sheet stock preform comprises a plurality of substantially rectangular panels which are adapted to receive the product elevator made of a thin sheet of plastic material with a product cup at one end for receiving the cosmetic product, and a tab and flexible cover member at the other end. The product elevator is moveable vertically upon assembly to retract or dispense product from the applicator.

15 Claims, 8 Drawing Sheets

TWO-PIECE COSMETIC APPLICATOR

TECHNICAL FIELD

The present invention relates to a two-piece cosmetic applicator for the application of cosmetic products such as lipstick, lip balm and the like. More particularly, this invention relates to a cosmetic applicator for packaging and dispensing cosmetic product adapted to allow consumers to open the applicator so that the cosmetic product is at an external location of the applicator for use and close the applicator so that the cosmetic product is retracted into the applicator for storage and reuse.

BACKGROUND OF THE INVENTION

Various types of packages and applicators for packaging and dispensing of cosmetic products are known in the prior art, in various sizes and shapes. Such packages usually include a container of two-piece assembly, a separate cover or closure to seal the container, a mechanism for receiving and raising and lowering the product within the package to present it in a proper position for use and to retract it into the package for storage and reuse. In many of these types of packages, the cover or closure and the container storing the product are separate pieces which often times may be disassociated from one another upon removal of closure for use thereby rendering the package from being sealed for storage and reuse. Further, many of these packages comprise three pieces which are delivered to the manufacturer of cosmetic products disassembled requiring the manufacturer to assemble the packages after the filling of the cosmetic product. These packages are more expensive to manufacture and assemble. U.S. Pat. No. 4,723,858 (Zinnbauer) discloses a known solid product dispensing package within the field of the present invention.

SUMMARY OF THE INVENTION

According to the present invention there is provided a sheet stock preform adapted to be folded to form a dispensing package and a product elevator adapted to receive cosmetic product and movable within the dispensing package toward and away from a product dispensing opening to present the cosmetic product for dispensing at a location external to said package and retracting the cosmetic product entirely into the container for storage and reuse. The two parts, the sheet stock preform adapted to be folded to form a dispensing package, and the product elevator assembled with the sheet stock preform for receiving said cosmetic product and dispensing said cosmetic product from the dispensing package, together comprise the two-piece cosmetic applicator. Prior art discloses cosmetic dispensing packages made of three or more pieces requiring two hands to use the package and apply the cosmetic product. In addition, prior art packages require additional steps of manufacture and assembly. The advantage of the present invention is that there are less parts to manufacture and that the additional step of assembly by the cosmetic product manufacturer is eliminated. The two-piece cosmetic applicator of the present invention is fully assembled and shipped to the manufacturer of cosmetic product; the manufacturer of the cosmetic product need only fill product elevator of the applicator with cosmetic product and seal the applicator upon filling thereby rendering the applicator ready for shipment to retailers.

An embodiment of the two-piece cosmetic applicator comprises an integrally molded plastic three-panel sheet stock preform, each of such panels substantially rectangular in shape and foldable at hinges, and a product elevator made of a thin sheet of resilient plastic material having a cup at one end for receiving the cosmetic product and a tab and flexible closure or cover member on the other end. The three-panel sheet stock preform has two outer panels, a front panel and a back panel, and one center panel between the two outer panels.

One of the outer panels, the front panel, has a longitudinal vertical groove adapted to receive and guide the tab of the product elevator up and down the vertical groove to allow the product to be dispensed. The front panel is adapted to form an opening of the applicator at the top end and has internal guide ribs at the bottom end to form a bottom cover and to guide the product elevator. The other of the outer panels, the back panel, has an elongated hollow product fill chamber which is hingedly secured to the bottom end of the outer panel adapted to receive the cup of the product elevator having the cosmetic product. The top end of the back panel forms an opening of the applicator. The center panel is equipped with a guide post at its bottom end which in conjunction with the internal guide ribs of the front panel allows the product elevator to be moved vertically within the hollow product fill chamber without causing the product elevator to bend, buckle or kink.

The two-piece cosmetic applicator is assembled by inserting the product receiving cup of the product elevator within the hollow product fill chamber so that the open end of the product receiving cup is positioned toward the top of the back panel. Once the product receiving cup of the product elevator is positioned in the product fill chamber in the back panel, the remaining portion of the product elevator including the tab and flexible closure member is placed between the guide post of the center panel and the guide ribs at the bottom of the front panel. Thereafter, the product fill chamber is folded about the hinge toward the back panel and simultaneously, the front panel and the back panel are folded about the hinges perpendicular to the center panel while positioning the thin sheet of resilient plastic material of the product elevator toward the outer edge of the product fill chamber, positioning the tab within the vertical groove of the front panel and, positioning the flexible closure member to cover the opening formed by the top of the front and the back panel. Finally, the front panel is attached to the back panel using an attachment means, which consists of a hook and corresponding groove to provide a snap fit. The cosmetic applicator is now ready to be shipped to the manufacturer of the cosmetic product for product filling.

The above-mentioned features and objects of the invention and the manner of attaining them will become more apparent and the invention itself will be understood by reference to the following description of an embodiment of the invention when considered in conjunction with the accompanying drawings.

DETAILED DESCRIPTION OF PREFERRED EMBODIMENT

Figure 1:
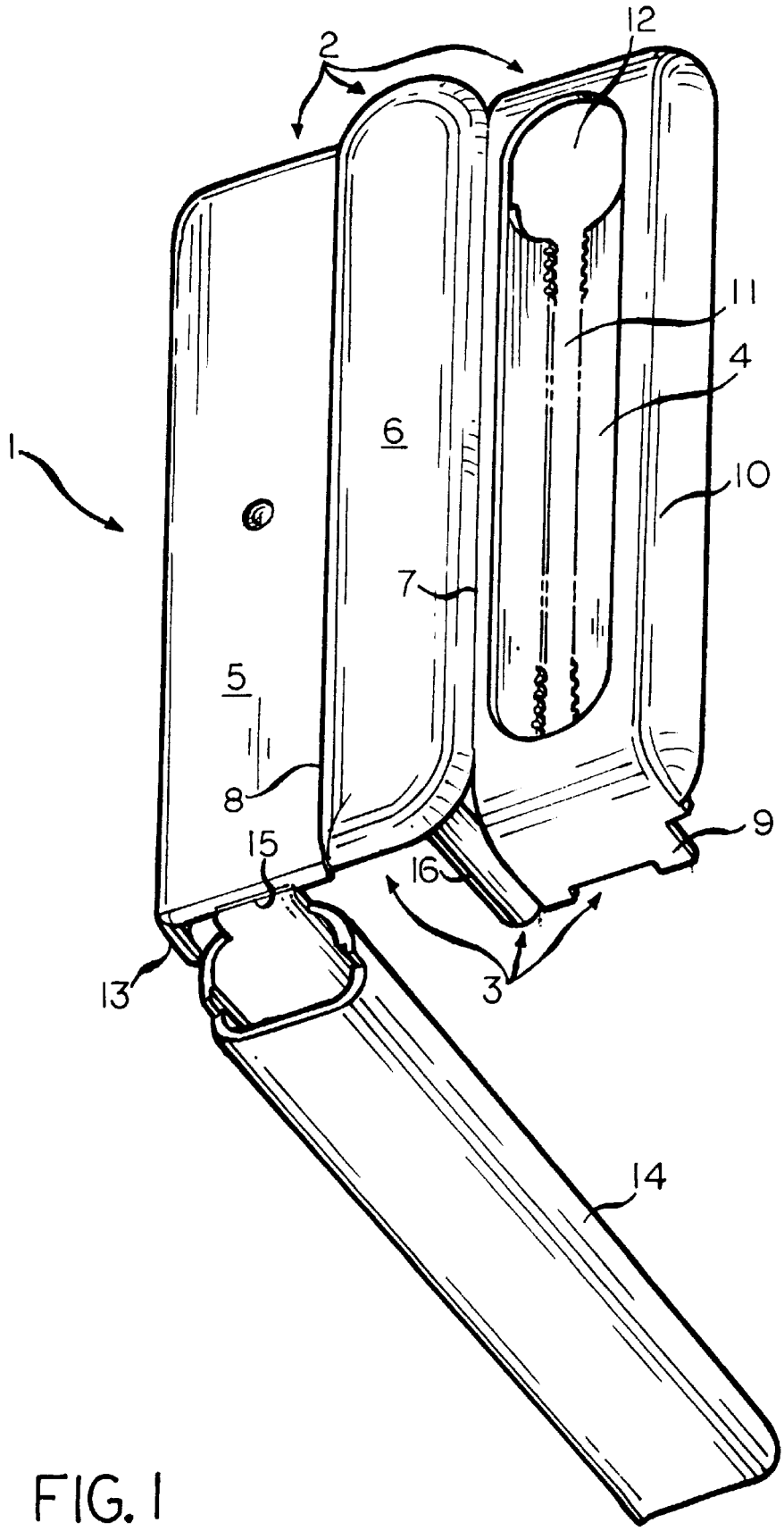
FIG. 1 is a perspective view of the external surfaces of a sheet stock preform according to the present invention.
Figure 7:
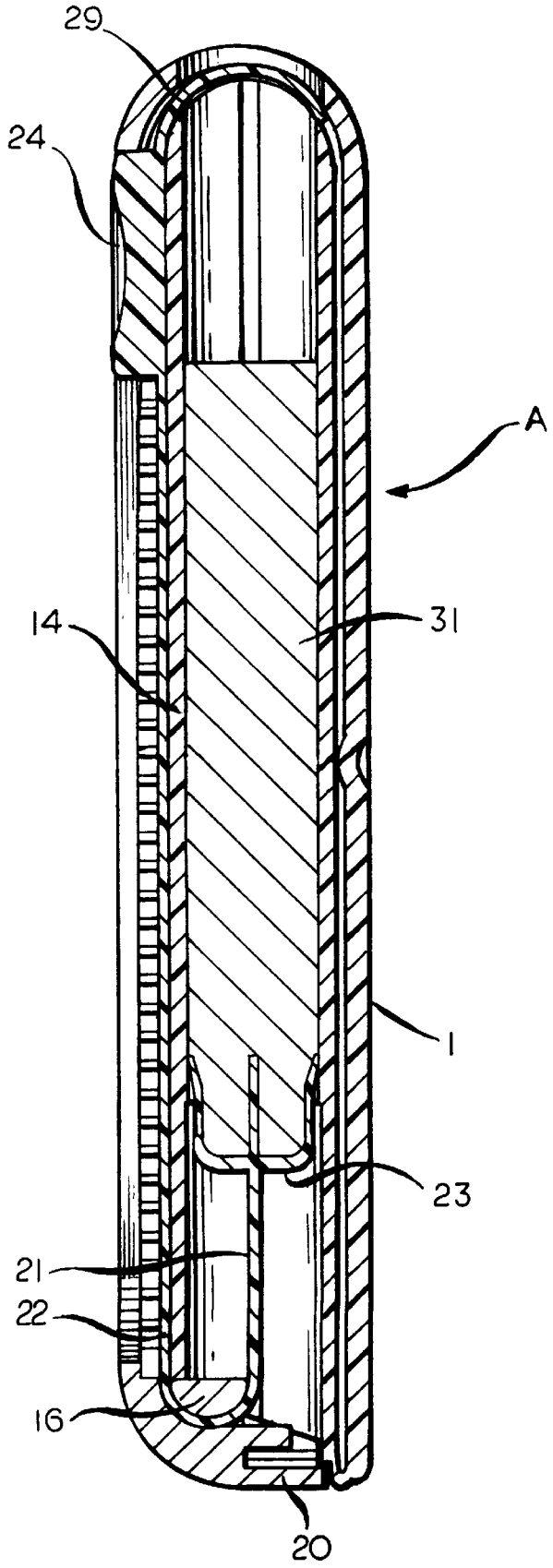
FIG. 7 is a fragmentary sectional view of an assembled two-piece cosmetic applicator with the sheet stock preform of FIGS. 1–5 and the product elevator of FIGS. 6A. and 6B. with a solid product to be dispensed contained therein.

FIG. 1 shows generally external surfaces of a sheet stock preform 1, with a top end 2 and a bottom end 3, which upon assembly will make up the external part of a two-piece dispensing applicator A (FIG. 7).

The sheet stock preform 1 comprises a front panel 4, a back panel 5 and a center panel 6 attached by hinges 7 and 8. Each of the panels 4, 5 and 6 are substantially rectangular in shape as illustrated in FIG. 1.

The front panel 4 has a bottom cover 9 which is adapted to cover the entire bottom end 3 of the sheet stock preform 1 which when folded at hinges 7 and 8 is assembled into the two-piece dispensing applicator A.

Figure 4:
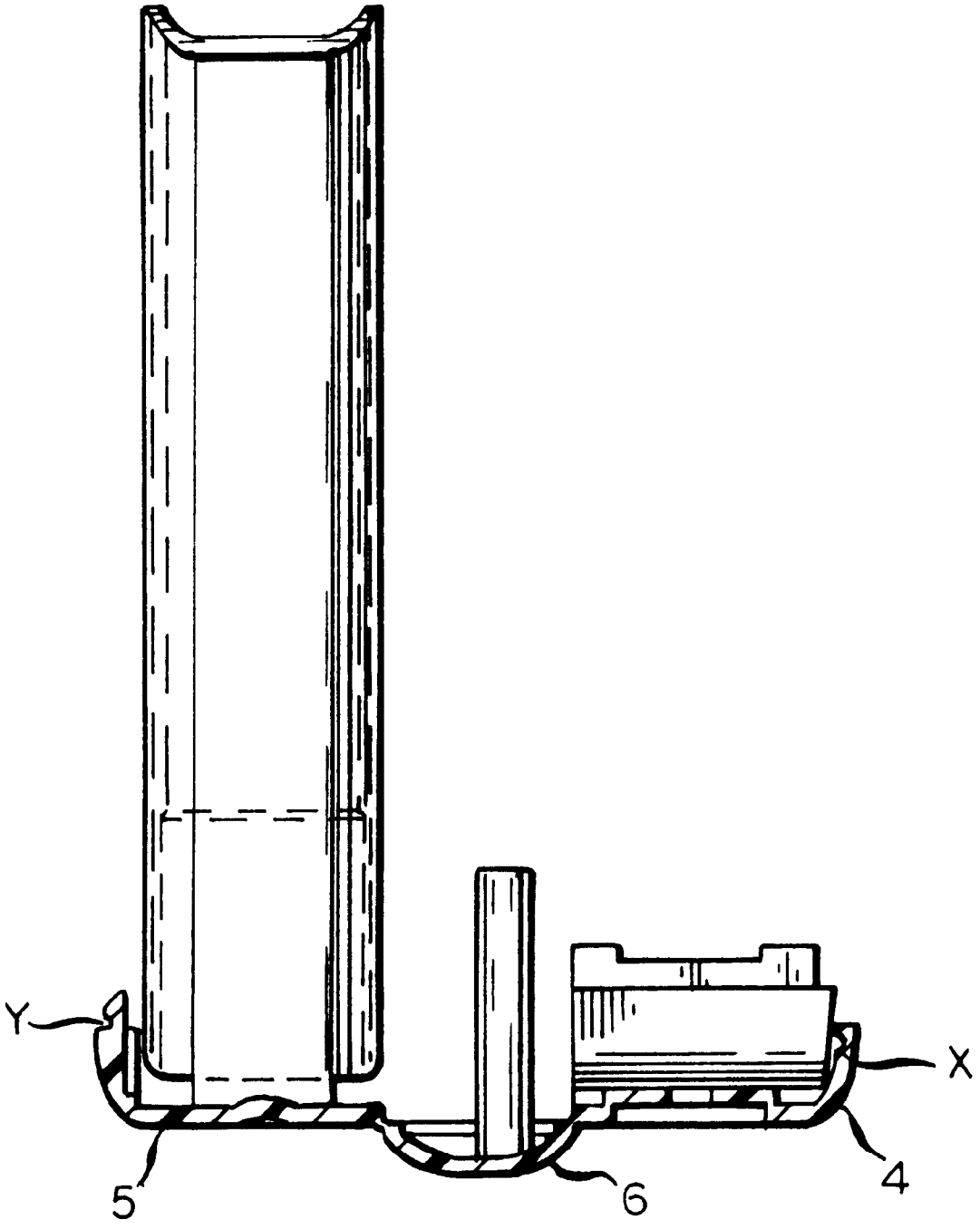
FIG. 4 is a sectional view taken on line 4—4 of FIG. 3.

The front panel 4 also has a peripheral side wall 10 which is equipped with an attachment means X (as shown in FIG. 4) capable of attaching the front panel 4 to the back panel 5. The front panel 4 as shown in FIG. 1 has a vertical groove 11 which extends from the top end 2 of the front panel 4 to the bottom end 3 of the front panel 4. The vertical groove 11 forms a larger diameter as generally depicted by reference 12 at the top end 2 of the front panel 4 so that a tab 24 of a product elevator 21 may be inserted into said groove for movement of the product elevator 21.

The back panel 5 has a peripheral side wall 13 which is also equipped with an attachment means Y (as shown in FIG. 4) capable of attaching the back panel 5 to the front panel 4. The back panel 5 has an elongated hollow product fill chamber 14 which is connected to the back panel 5 at the bottom end 3 by a hinge 15. The elongated hollow product fill chamber 14 is open at both ends and adapted to receive a product receiving cup 23 of the product elevator 21. The fill chamber 14 extends perpendicular to the back panel 5 which upon assembly is folded at the hinge 15 to lie adjacent an internal surface the back panel 5.

The center panel 6 has a guide post 16 at the bottom end 3 of the center panel 6 molded at the bottom corner adjacent to the front panel 4. The center panel 6 is attached to the front panel 4 by the hinge 7 and attached to the back panel 5 by the hinge 8.

Figure 2:
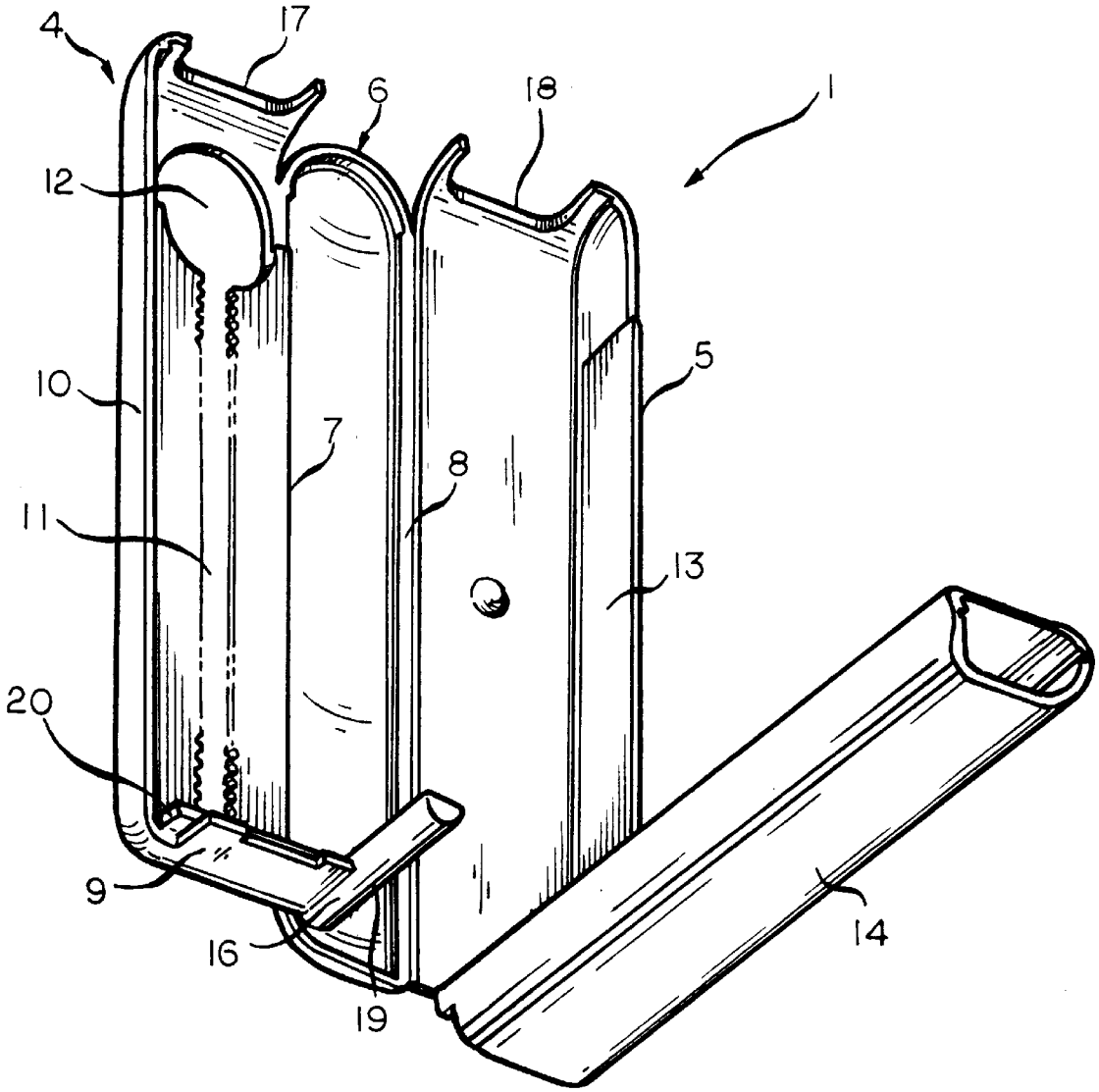
FIG. 2 is a perspective view of the internal surfaces of the sheet stock preform of FIG. 1.
Figure 8:
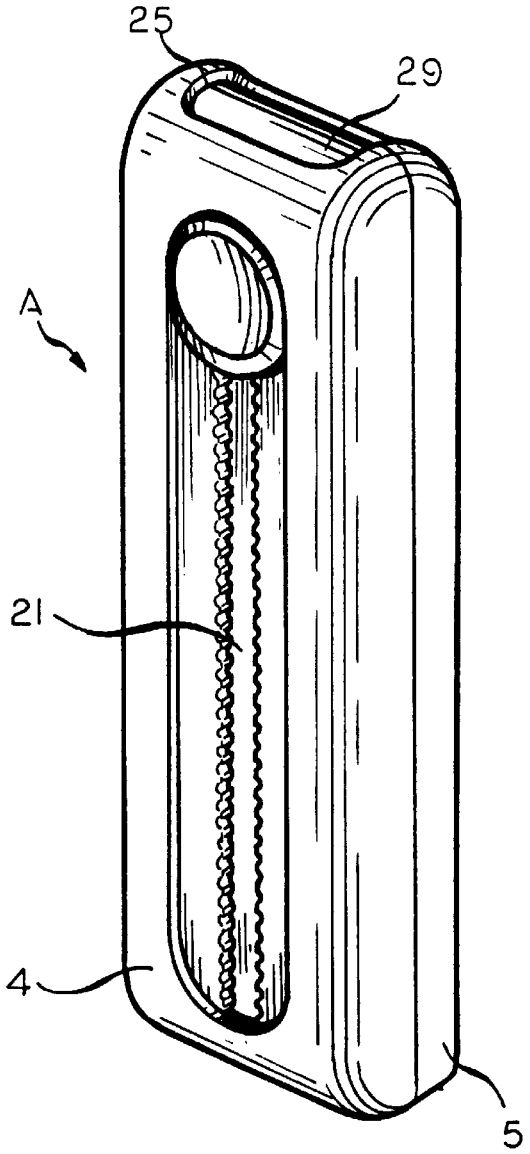
FIG. 8 is a perspective view of the two-piece cosmetic applicator of FIG. 7.
Figure 9:
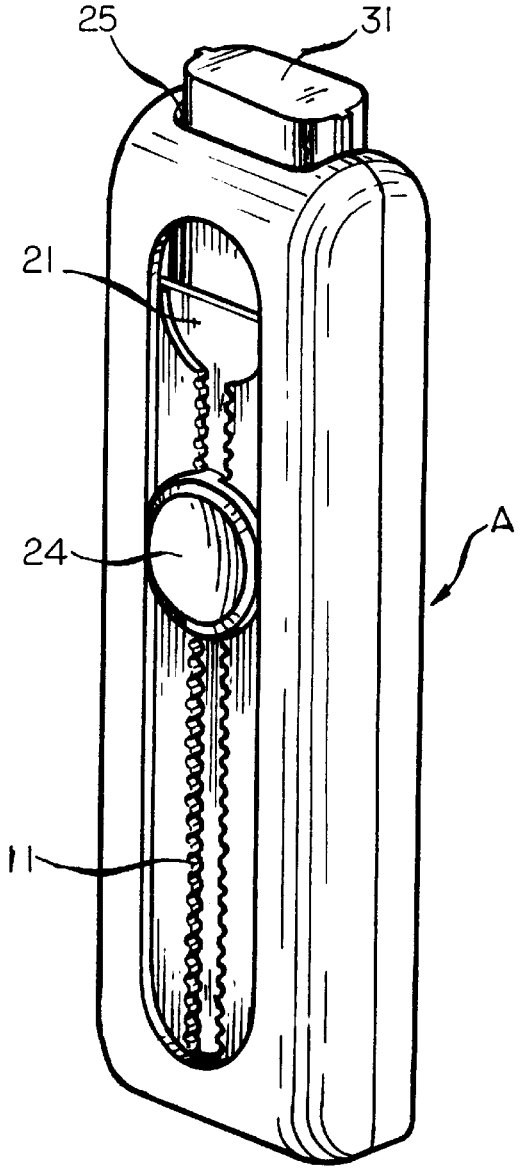
FIG. 9 is a perspective view of the two-piece cosmetic applicator of FIGS. 7 and 8 in an open position to show the cosmetic product external to the applicator for use by consumer.

FIG. 2 shows that a top opening 17 of the front panel 4 is shaped to cooperate with a top opening 18 of the back panel 5 to form a product dispensing opening 25 (as shown in FIGS. 8 and 9). FIG. 2 also shows that a guide post 16 which is semicylindrical in shape has a curved portion 19 toward the bottom end 3 of the center panel 6. The curved portion 19 facilitates the movement of the product elevator 21 upon assembly of the two-piece cosmetic applicator A in a manner so as to prevent a thin sheet of resilient plastic material 22 of the product elevator 21 from bending, buckling or kinking. FIG. 2 further shows that a bottom cover 9 of the front panel 4 has guide ribs 20 in an internal surface of the sheet stock preform. These internal guide ribs 20 cooperate with the guide post 16 of the center panel 6 to smoothly guide the movement of the thin sheet of resilient plastic material 22 of the product elevator 21.

Figure 3:
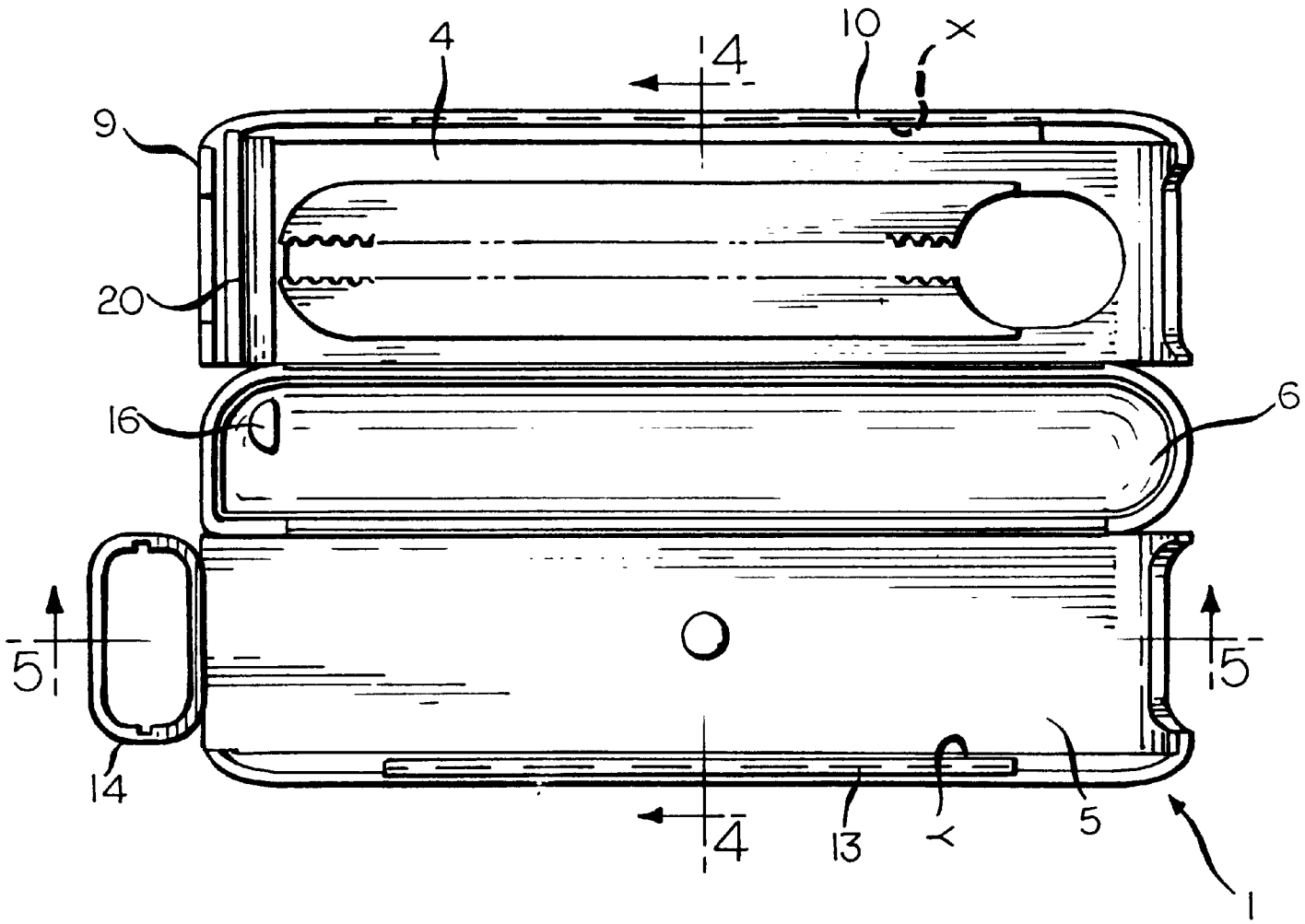
FIG. 3 is a top plan view of the internal surfaces of the sheet stock preform of FIGS. 1 and 2.

FIG. 3 illustrates the internal surfaces of the front, back and center panels 4, 5, 6 of the sheet stock preform. The guide ribs 20 on the internal surface of the bottom cover 9 comprise steps which allow the thin sheet of resilient plastic material 22 of the product elevator 21 in cooperation with the guide post 16 of the center panel to easily move within the assembled two-piece cosmetic applicator in order to retract and advance a product 31 (FIG. 7) in the cup 23 of the product elevator.

FIG. 3 also shows the peripheral side walls 10 and 13 of the front panel 4 and back panel 5 respectively with attachment means X on the front panel 4 and attachment means Y on the back panel 5. While the attachment means X and Y in this embodiment have a hook and groove as further depicted in FIG. 4, wide variety of other attachment means such as a bead and groove may also be effectively employed.

FIG. 4 depicts the attachment means X and Y where attachment means X on the front panel 4 comprising a groove cooperates with attachment means Y on the back panel 5 comprising a hook.

Figure 5:
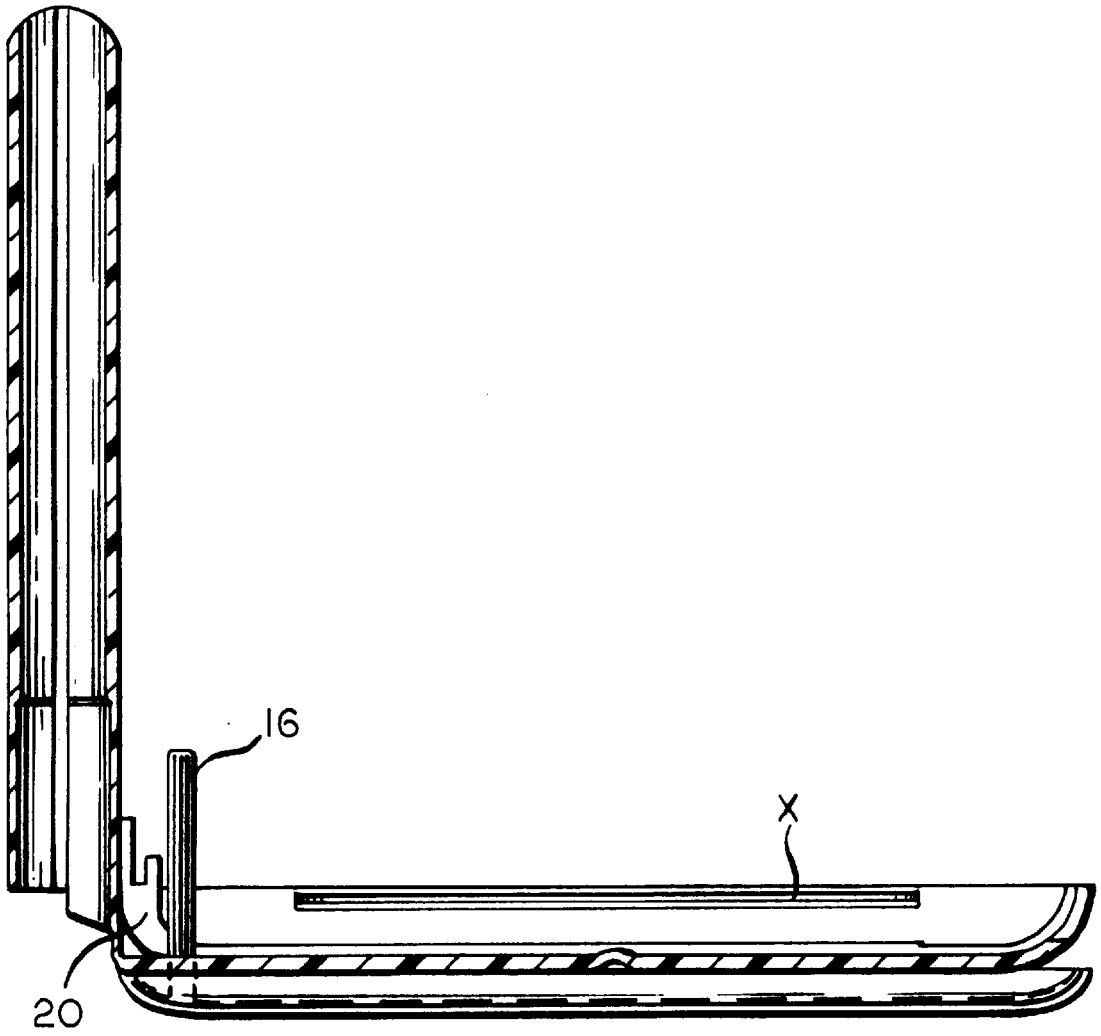
FIG. 5 is a sectional view taken on line 5—5 of FIG. 3.

FIG. 5 shows the configuration of the guide post 16 and guide ribs 20 wherein the thin sheet of resilient plastic material 22 of the product elevator 21 is placed between the guide post 16 and guide ribs 20 during assembly of the two-piece cosmetic applicator.

Figure 6A:
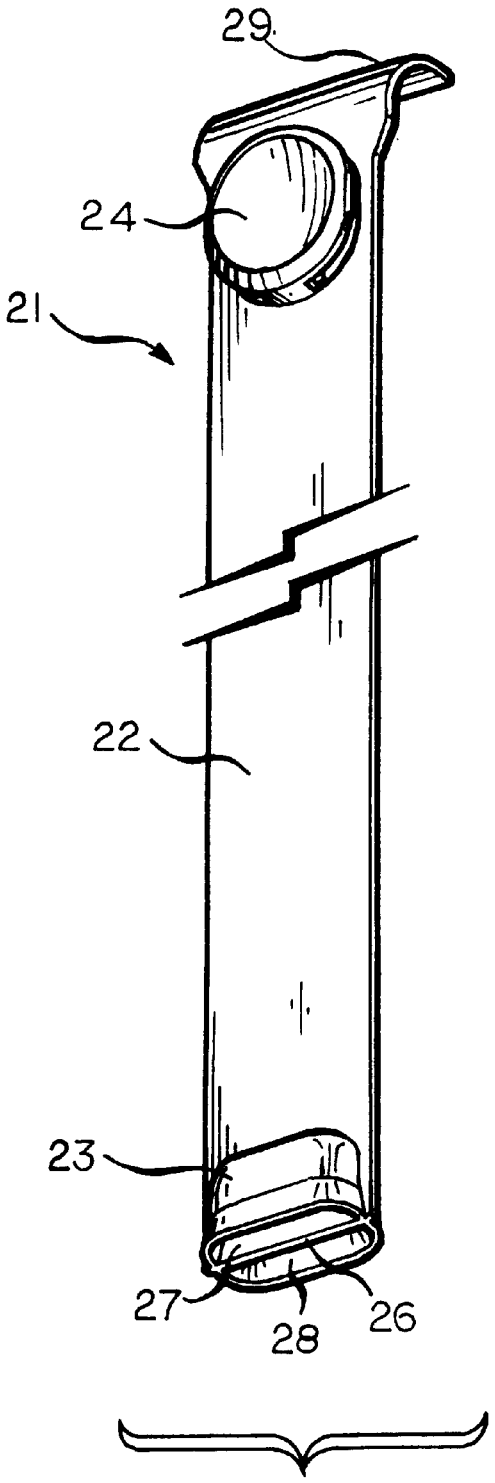
FIG. 6A. is a perspective view of a product elevator according to the present invention showing the product receiving cup, tab and flexible closure member.
Figure 6B:
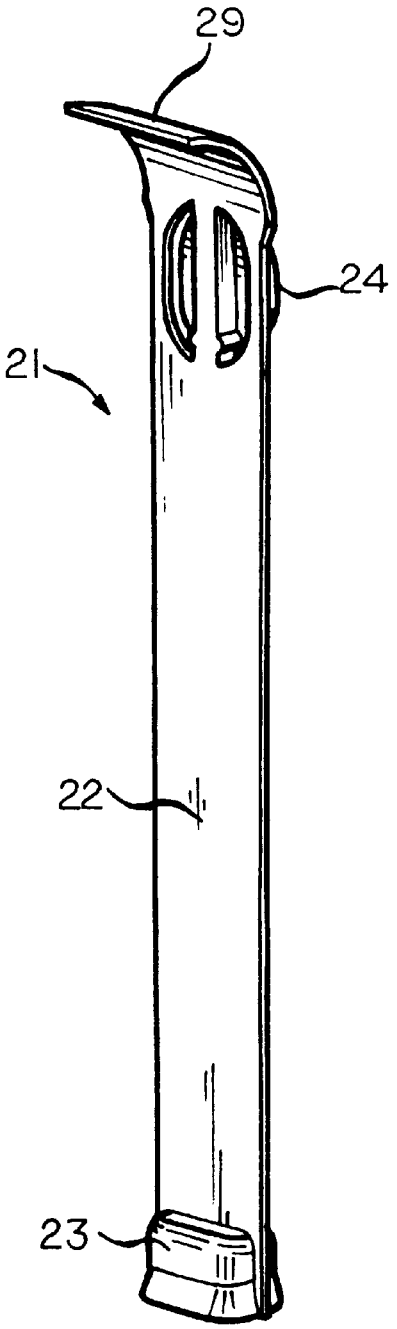
FIG. 6B. is a perspective view from a different position of the product elevator of FIG. 6A. showing the product receiving cup and flexible closure member.

As shown in FIGS. 6A and 6B, the product elevator 21 has a thin sheet of resilient plastic material 22, a product receiving cup 23 positioned at one end of the thin sheet of resilient plastic material 22 and a flexible closure member 29 positioned at the other end of the thin sheet of resilient plastic material. Molded below the flexible closure member 29 is a tab 24. Tab 24 projects outwardly from the thin sheet of resilient plastic ribbon as shown in FIG. 6A. As shown in FIGS. 6A and 6B, the flexible closure member 29 has a width at the top greater than the width of the thin sheet of resilient plastic ribbon. This extra width assures complete sealing of the two-piece cosmetic applicator's product dispensing opening 25 protecting the product 31 within the applicator from being contacted while in storage and not in use. As shown in FIGS. 6A and 6B, the product receiving cup 23 is shaped in a manner so as to allow the secure housing of the product 31. The secure housing of the product 31 is further enhanced by providing a plastic wall 26 molded in the center of the cup from the top of the cup to the bottom of the cup so as to divide the product receiving cup 23 into two compartments 27 and 28 as shown in FIG. 6A.

FIG. 7 shows the assembled two-piece cosmetic applicator A with the sheet stock preform 1 and the product elevator 21. The method of assembling the two-piece cosmetic applicator comprises the step of inserting the product receiving cup 23 of the product elevator 21 within the bottom portion of the hollow product fill chamber 14 in a manner where the open end of the product receiving cup 23 is pointing toward the top of the hollow product fill chamber 14. The thin sheet of resilient plastic material 22 with the flexible closure member 29 and the tab 24 is then placed between the guide post 16 of the center panel 6 and guide ribs 20 of the front panel 4, folding the product chamber 14 about the hinge 15 toward the back panel 5 and simultaneously positioning the thin sheet of plastic material 22 toward the outer edge of the product fill chamber so that the tab 24 is positioned within the large diameter 12 of the vertical groove 11 in the front panel 4 and the flexible closure member 29 is positioned so as to cover the entire product dispensing opening 25. Finally, the front panel 4 is attached to the back panel 5 by attachment means X and Y. Once the two-piece cosmetic applicator A is assembled, it may be sent to manufacturer of the cosmetic product for filling of the product and shipment to the consumer. It is preferred that the two-piece cosmetic applicator be shipped to the consumer in an open position so that the flexible closure member 29 is entirely retracted into the applicator A so that the manufacturer may fill the product receiving cup 23 with the product 31 and upon filling, may move the tab toward the top of the applicator so that the flexible closure member 29 is positioned to cover the entire product dispensing opening 25.

Upon assembly of the applicator, the product receiving cup 23 of the product elevator 21 is movable within the hollow product fill chamber 14 toward and away from the product dispensing opening 7 by the tab 24 to present the product 31 in the cup 23 for dispensing at a location external to the applicator A when the cup is near the product dispensing opening 7 and to retract the product entirely into the applicator A for storage when the cup 23 is entirely within the applicator A.

FIG. 8 shows the fully assembled two-piece cosmetic applicator A wherein the sheet stock preform 1, is folded about the hinges to form a dispensing package 4, with the product elevator 21 assembled within the sheet stock preform 1.

FIG. 8 shows the two-piece cosmetic applicator A, in a closed position where the flexible closure member 29 is covering the product, not visible in the drawing, within the cosmetic dispensing opening 25 to protect the cosmetic product when retracted into the applicator A for storage. As seen in FIG. 8, the product dispensing opening 25 is formed by reciprocal top ends of the front panel 4 and the back panel 5.

FIG. 9 illustrates the fully assembled two-piece cosmetic applicator A wherein the tab 24 of the product elevator 21 is moved toward the bottom of the applicator within the vertical grooves 11 so that the cosmetic product 31 is moved external to the applicator A above the product dispensing opening 25 for consumer use.

Although the invention has been illustrated and disclosed with reference to a specific embodiment, it is to be understood that modifications may be made to the invention without departing from the spirit of the invention or from the scope of the following claims.

What is claimed is:

1. An applicator for dispensing solid cosmetic product, said applicator comprising:

a plurality of panels each having a top end and a bottom end, said panels connected by hinges wherein the number of hinges is one less than the number of panels, one of said panels having a peripheral side wall and a vertical groove, another one of said panels having a peripheral side wall, and an elongated hollow product fill chamber hingedly secured to said another one of said panels, and yet another one of said panels having a guide post; and a product elevator received within the product fill chamber, said product elevator comprising a product receiving cup, a tab and a flexible closure member.

2. The applicator of claim 1, wherein each of said panels is substantially rectangular in shape.

3. The applicator of claim 1, wherein said plurality comprises a front panel, a back panel and a center panel.

4. The applicator of claim 3, wherein the vertical groove in said front panel extends from the bottom end of said front panel to the top end of said front panel, said vertical groove having a larger diameter at the position adjacent to the top end.

5. The applicator of claim 3, wherein the bottom end of said front panel comprises internal guide ribs adapted to form a bottom cover, the top end of said front panel being adapted to form a product dispensing opening, and the peripheral side wall of said panel having a means for attaching said front panel to said back panel.

6. The applicator of claim 3, wherein the elongated hollow product fill chamber in said back panel has openings at both ends.

7. The applicator of claim 3, wherein the top end of said back panel is adapted to form a product dispensing opening and the peripheral side wall of said back panel having a means for attaching said back panel to said front panel.

8. The applicator of claim 3, wherein the bottom end of said center panel is equipped with the guide post mounted perpendicular to the sheet-stock preform, the guide post being of a solid cylindrical shape.

9. The applicator of claim 1, wherein said product elevator comprises a thin sheet of resilient plastic material, wherein the product receiving cup is positioned at one end of said sheet of resilient plastic material, and the tab and the flexible closure member are positioned at the other end of said sheet of resilient plastic material and wherein the tab is molded below the flexible closure member.

10. A package comprising the applicator of claim 1, further comprising a solid stick of product contained within said product receiving cup.

11. The applicator of claim 1, wherein the tab of said product elevator projects outwardly from said thin sheet of resilient plastic material.

12. The applicator of claim 1, wherein the flexible closure member of said product elevator has a width at a top end of said flexible closure member greater than a width of the thin sheet of resilient plastic material of said product elevator at adjacent end of said product elevator.

13. The applicator of claim 1, wherein said product receiving cup of said product elevator is movable within said product fill chamber toward and away from said product dispensing opening by advancing the tab toward and away from said product dispensing opening to present a solid product in said cup for dispensing at a location external to said package when said cup is near said product dispensing opening and to retract said solid product entirely into said container for storage when said cup is remote from said product dispensing opening, advancing of said tab toward said product dispensing opening being effective to retract said flexible closure member from a closing position relative to the product dispensing opening, retracting of said cup away from said product dispensing opening being effective to advance said flexible closure member into a closing position relative to said product dispensing opening.

14. A method of assembling a dispenser for dispensing solid cosmetic product, said method comprising the steps of:

providing a package for dispensing solid cosmetic product, said package comprising a plurality of panels each having a top end and a bottom end, said panels connected by hinges wherein the number of hinges is one less than the number of panels, another one of said panels having a peripheral side wall, and a vertical groove, one of said panels having a peripheral side wall, and an elongated hollow product fill chamber hingedly secured to said one of said panels, yet another one of said panels having a guide post;

and providing a product elevator adapted to be received within the product fill chamber, said product elevator comprising a product receiving cup, a tab and a flexible closure member, said product elevator comprises a thin sheet of resilient plastic material, wherein said product receiving cup is positioned at one end of said sheet of resilient plastic material, and the tab and the flexible closure member are positioned at the other end of said sheet of resilient plastic material and wherein the tab is molded below the flexible closure member;

inserting the product receiving cup of the product elevator within the bottom of the hollow product fill chamber positioned with the open end of the product receiving cup pointing toward the top of the hollow product fill chamber;

placing the thin sheet of resilient plastic material of the product elevator between the guide post of the center panel and bottom end of the front panel;

folding the product fill chamber of the back panel about the hinge toward the back panel and simultaneously folding the front panel and the back panel about the living hinges perpendicular to the center panel; and positioning the thin sheet of resilient plastic material of the product elevator towards the outer edge of the product fill chamber wherein the tab is positioned within the larger diameter of the vertical groove in the front panel and the flexible closure is positioned to cover the opening formed by the top of the front panel and the back panel, attaching said front panel to said back panel by an attachment means.

15. The method of claim 14, further comprising adding product to said product elevator cup.

* * * * *